US007241959B1

(12) United States Patent
Lin

(10) Patent No.: US 7,241,959 B1
(45) Date of Patent: Jul. 10, 2007

(54) MECHANICAL POWER BREAKER FOR A VEHICLE

(76) Inventor: Ling-Hsin Lin, No. 653, Demei Rd., Heimei Chen, Changhua Hsien (TW)

( * ) Notice: Subject to any disclaimer, the term of this patent is extended or adjusted under 35 U.S.C. 154(b) by 44 days.

(21) Appl. No.: 11/342,698

(22) Filed: Jan. 31, 2006

(51) Int. Cl.
*H01H 85/00* (2006.01)

(52) U.S. Cl. ..... 200/61.08; 73/514.35

(58) Field of Classification Search ..... 200/61.45 R–61.53, 61.08, 300; 73/514.35, 514.01, 73/514.02

See application file for complete search history.

(56) References Cited

U.S. PATENT DOCUMENTS 3,794,794 A * 2/1974 Provancher ..... 200/61.53
4,224,487 A * 9/1980 Simonsen ..... 200/61.08
4,417,519 A * 11/1983 Lutz ..... 200/61.08
5,535,842 A * 7/1996 Richter et al. ..... 200/61.08
5,877,563 A * 3/1999 Krappel et al. ..... 307/10.1
6,232,568 B1 * 5/2001 Hasegawa et al. ..... 200/61.08
6,252,477 B1 * 6/2001 Endo et al. ..... 200/541
7,078,635 B2 * 7/2006 Kordel et al. ..... 200/61.08

* cited by examiner

*Primary Examiner*—Elvin Enad
*Assistant Examiner*—M. Fishman
(74) *Attorney, Agent, or Firm*—Rabin & Berdo, P.C.

(57) ABSTRACT

A mechanical power breaker for a vehicle has a casing, a power input, a master power output, and a breaker positioned in the casing and electrically connected between the power input and master power output. The breaker has a seat, a conductive connector, a moving element, and a first and second resilient supports. The conductive connector is held in seat by the first resilient support and formed by multiple conductive blocks stacked together. The conductive connector and first resilient support are electrically connected between the power input and the master power output. The hollow moving element is held in the seat by the second resilient supports to surround the conductive connector. If the casing is shaken, the moving element is moved to hit the conductive connector. The conductive connector is separated into the multiple conductive blocks to disconnect the electronic connection between the power input and master power output.

7 Claims, 3 Drawing Sheets

MECHANICAL POWER BREAKER FOR A VEHICLE

BACKGROUND OF THE INVENTION

1. Field of the Invention

The present invention relates to a power breaker, and more particularly to a mechanical type power breaker for use in a vehicle.

2. Description of Related Art

How to ensure the vehicle safety in driving situation is an important issue for most of the vehicle manufacturing factories. The vehicle manufacturing factories are dedicated to improve two important aspects. One aspect is mechanical safety structure and the other is a vehicle circuit protection system.

The mechanical safety structure is assembled to the inside of the vehicle to prevent the driver from being hurt when a collision suddenly occurs. The vehicle circuit protection system prevents the vehicle circuit from being short that may cause a fire when the vehicle is crashed and the gasoline leaks from a fuel tank of the vehicle. However the vehicle circuit protection system is not common.

Therefore, the present invention provides a mechanical power breaker for a vehicle to prevent the vehicle circuit from a short circuit when the vehicle is crashed.

SUMMARY OF THE INVENTION

The main objective of the present invention is to provide a vehicle power breaker with a mechanical structure that is able to be immediately be activated when the vehicle experiences a collision.

A mechanical power breaker for a vehicle has a casing, a power input, a master power output, and a breaker. The power input and a master power output are mounted on the casing and the breaker is positioned inside of the casing and electrically connected between the power input and the master power output. The breaker has a seat, a conductive connector, a moving element, a first resilient support and multiple second resilient supports. The conductive connector is held in the seat by the first resilient support and is consisted of multiple conductive blocks stacked to a long pillar. The conductive connector and the first resilient support are electrically connected between the power input and the master power output. The hollow moving element is held in the seat by the second resilient supports. The conductive connector is surrounded with the hollow moving element. If the casing is shaken, the moving element is moved to hit the conductive connector. The conductive connector is separated into the multiple conductive blocks to disconnect the electronic connection between the power input and master power output.

The second objective of the present invention is to provide a vehicle power breaker device that further has an auxiliary power output used to connect to a safety bag device or an anti-locking brake device.

The auxiliary power output is mounted to the casing and electrically connected to the power input through the first resilient support. Therefore, even when the power breaker is shaken, the power input is still electrically connected to the auxiliary power to supply power to the safety bag device or the anti-locking brake device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
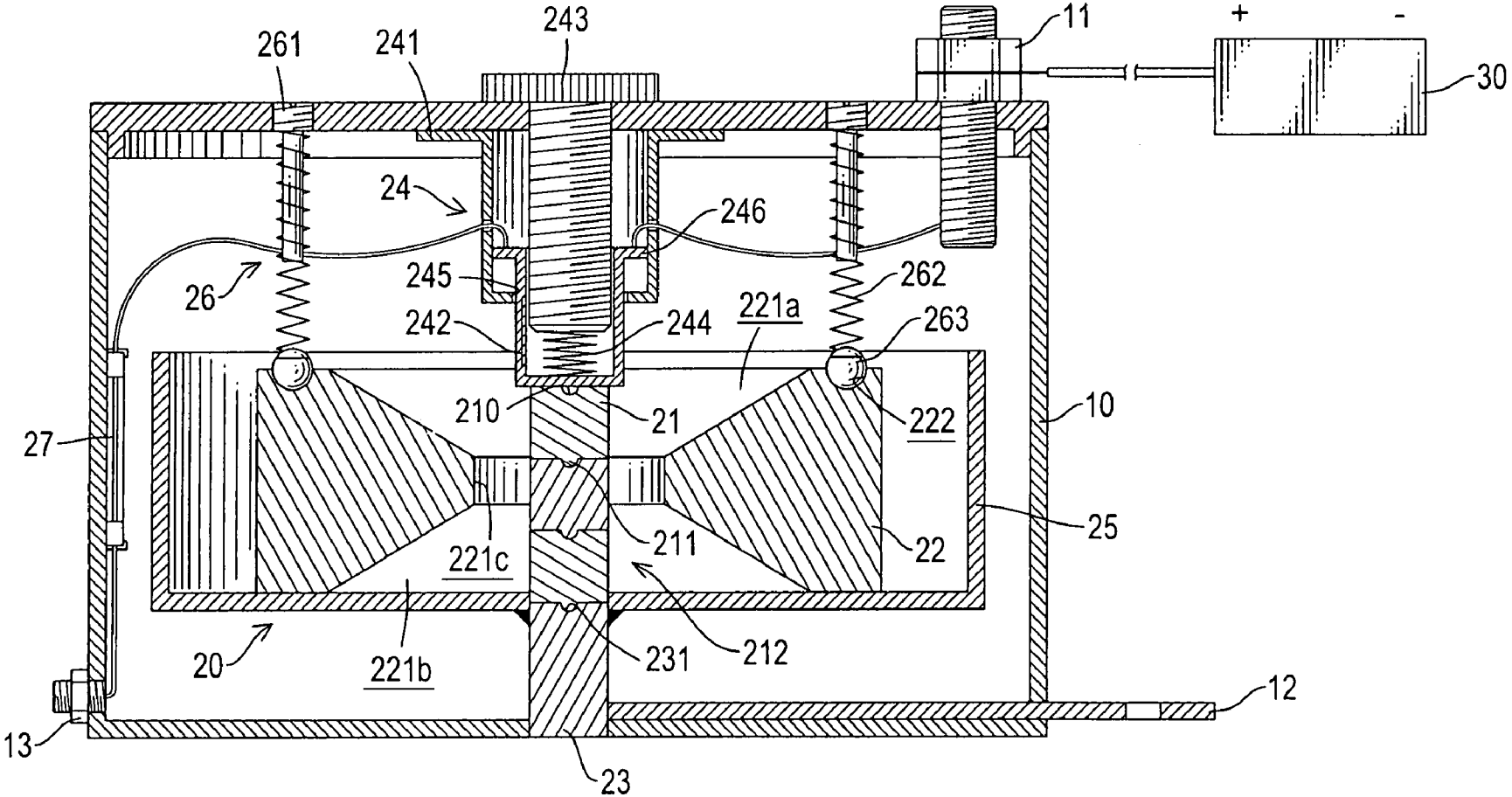
FIG. 1 is a cross sectional view of a mechanical power breaker in accordance with the present invention.

With reference to FIG. 1, a preferred embodiment of a mechanical power breaker in accordance with the present invention has a casing (10), a power input (11), a master power output (12), an optional auxiliary power output (13) and a breaker (20).

Figure 2:
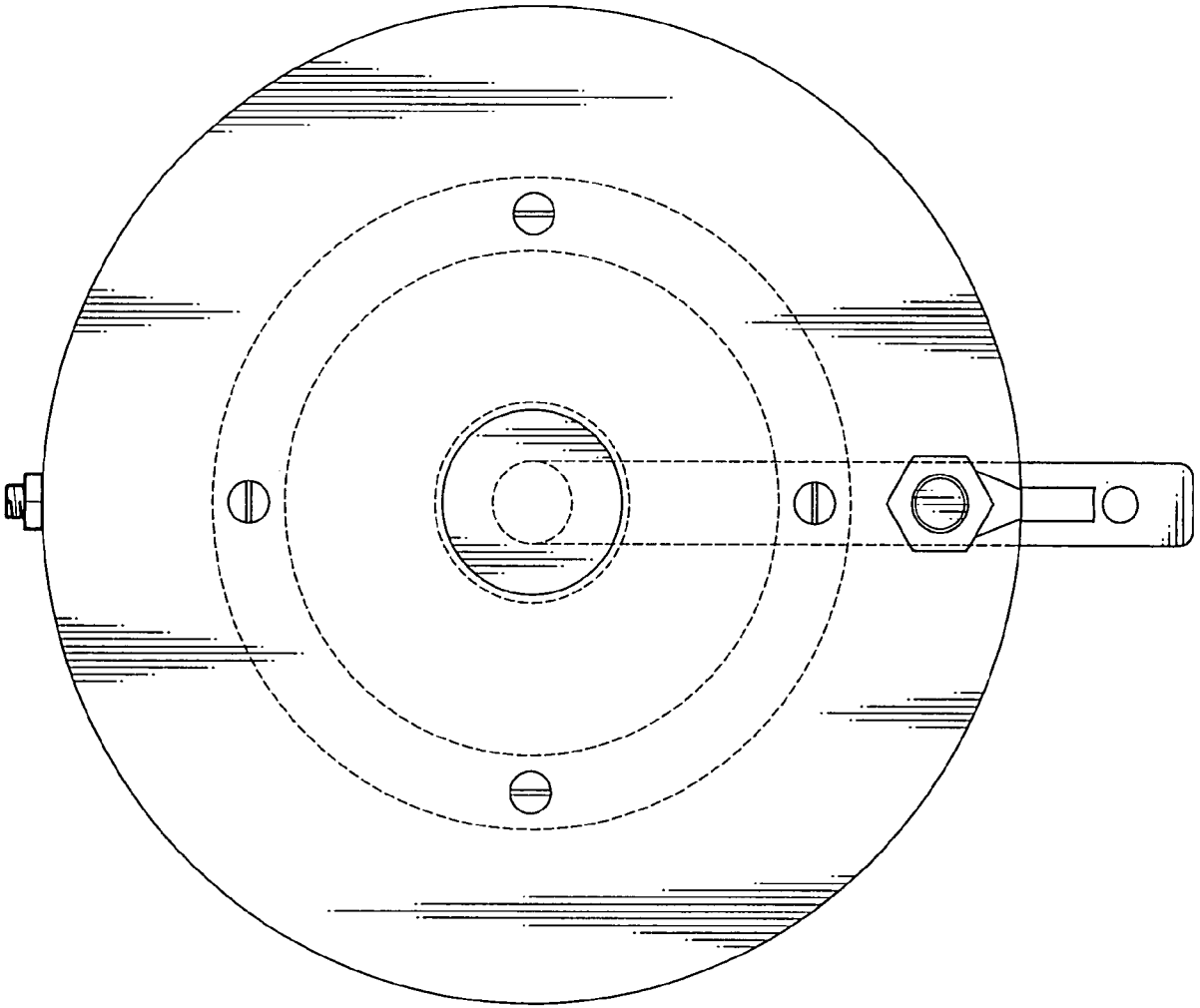
FIG. 2 is a top plan view of the mechanical power breaker in accordance with the present invention.

With further reference to FIG. 2, the casing (10) is formed of a circular shape has a top and a bottom. The power input (11) and the master and auxiliary power outputs (12, 13) are mounted to an outside of the casing (10). The power input (11) is connected to a positive electrode (+) of a vehicle battery (30). The master power output (12) is connected to a power terminal of vehicle power system (not shown). The auxiliary power output (13) is connected to a power terminal of a safety electric circuit (not shown) of a safety apparatus, such as an air bag device or an anti-locking brake device.

The breaker (20) is inside of the casing (10) and electrically connected among the power input (11), the master power output (12) and the auxiliary power output (13). The breaker (20) has a seat (25), a conductive connector (212), a moving element (22), a first resilient support (24) and multiple second resilient supports (26).

The seat (25) has an upper opening, a bottom, a through hole defined in the bottom and a pillar (23). The pillar (23) is conductive, electrically connected to the master power output (12), and has an upper side, a bottom side and an optional recess (231). The upper side and lower side of the pillar (23) are respectively and securely mounted between the bottom of the seat (25) and the bottom of the casing (10). The recess (231) is defined on the upper side.

The conductive connector (212) is consisted of multiple conductive blocks (21) that are stacked to form a separable long pillar. The conductive connector (212) is positioned in the through hole of the bottom of the seat (25). Each conductive block (21) is able to be made of metal, carbon or any conductive material and has a top face and a bottom face. The top face is defined with a recess (210) and the bottom face forms with a bump (211). The bump (211) is held in the recess (210) of an adjacent conductive block (21). Therefore, the multiple conductive blocks (21) are stacked together to form the long pillar. The lowest bump (211) of the conductive connector (212) is held in the recess (231) of the pillar (23) through the through hole of the seat (25).

The moving element (22) is put on the bottom of the seat (25) and has a width, an upper surface, a lower surface, multiple ball holes (222), an upper taper opening (221*a*), a lower taper opening (221*b*) and a center hole (221*c*) communicating between the upper and lower taper openings (221*a*, 221*b*). The width of the moving element (21) is smaller than that of the seat (25). The lower surface touches to the bottom of the seat (25) when the moving element (21) is put in the seat (25). The upper and lower surfaces are symmetrical. The multiple ball holes (222) are defined on the upper surface. A width of the center hole (221*c*) is larger than that of each conductive block (21). Therefore, the conductive connector (212) is positioned in the upper and lower openings (221*a*, 221*b*) and center hole (221*c*) of the moving element (22).

The first resilient support (24) is mounted on the top of the casing (10), extends downward the inside of the casing (10), and provides a pressing force against the top conductive block (21) of the conductive connector (212) to temporarily keep all the conductive blocks (21) at the stacked status. Therefore, the conductive connector (212) is held between the first resilient support (24) and the pillar (23) and positioned inside the seat (25). The first resilient support (24) has a fixed seat (241), a sliding conductive sleeve (242), a screw (243) and a spring (244).

The fixed seat (241) is securely and downwardly mounted on the top of casing (10) and has a center opening (245). The sliding conductive sleeve (242) is held in the fixed seat (241) and passes through the center opening (245) of the fixed seat (241). The sliding conductive sleeve (242) has a stop portion (246) extended to an outside of the sliding conductive sleeve (242), so the stop portion (246) can abut against an inside of the fixed seat (241). Therefore, the sliding conductive sleeve (242) is movable in the fixed seat (241). The sliding conductive sleeve (242) is electrically connected to the power input (11) and electrically connected to the auxiliary power output (13) through a fuse (27). The sliding conductive sleeve (242) passing through the center opening (245) of the fixed seat (241) abuts against the top face of the top conductive block (21) of the conductive connector (212). Therefore, the power input (11) is electrically connected to the master power output (12) through the sliding conductive sleeve (242), the conductive connector (212) and the pillar (23). The spring (244) has two opposite ends wherein one end is connected to the sliding conductive sleeve (242). The screw (243) is screwed in the top of the casing (10) and into the fixed seat (241) and the sliding conductive sleeve (242) to press against the other end of the spring (244). Since the screw (243) is screwed on the top of the casing (10) and presses against the spring (244) in the sliding conductive sleeve (242), the pressing force on the top conductive block (21) of the conductive connector (212) is adjustable by turning around the screw (243).

The multiple second resilient support (26) are also fixed on the top of casing (10), extends downward the inside of the casing (10), and provide pressing forces to the top surface of the moving element in the seat (25). Each second resilient support (26) has a screw (261), a spring (262) and a ball (263). The screw (261) is screwed on the top of the casing (10). The spring (262) has two opposite ends, wherein one end is connected to the screw (261) and the other end presses against the ball (263). The ball (263) is held in the corresponding ball hole (222). Therefore, the springs (262) are fixed on the top of the casing (10) by the screws (261) and provide the pressing force to the top surface of the moving element (22) through the balls (263). The moving element (22) will be temporarily held in the seat (25) by the second resilient supports (26). The strength of the pressing force of each second resilient support (26) is also adjustable by turning around the screws (261).

Figure 3:
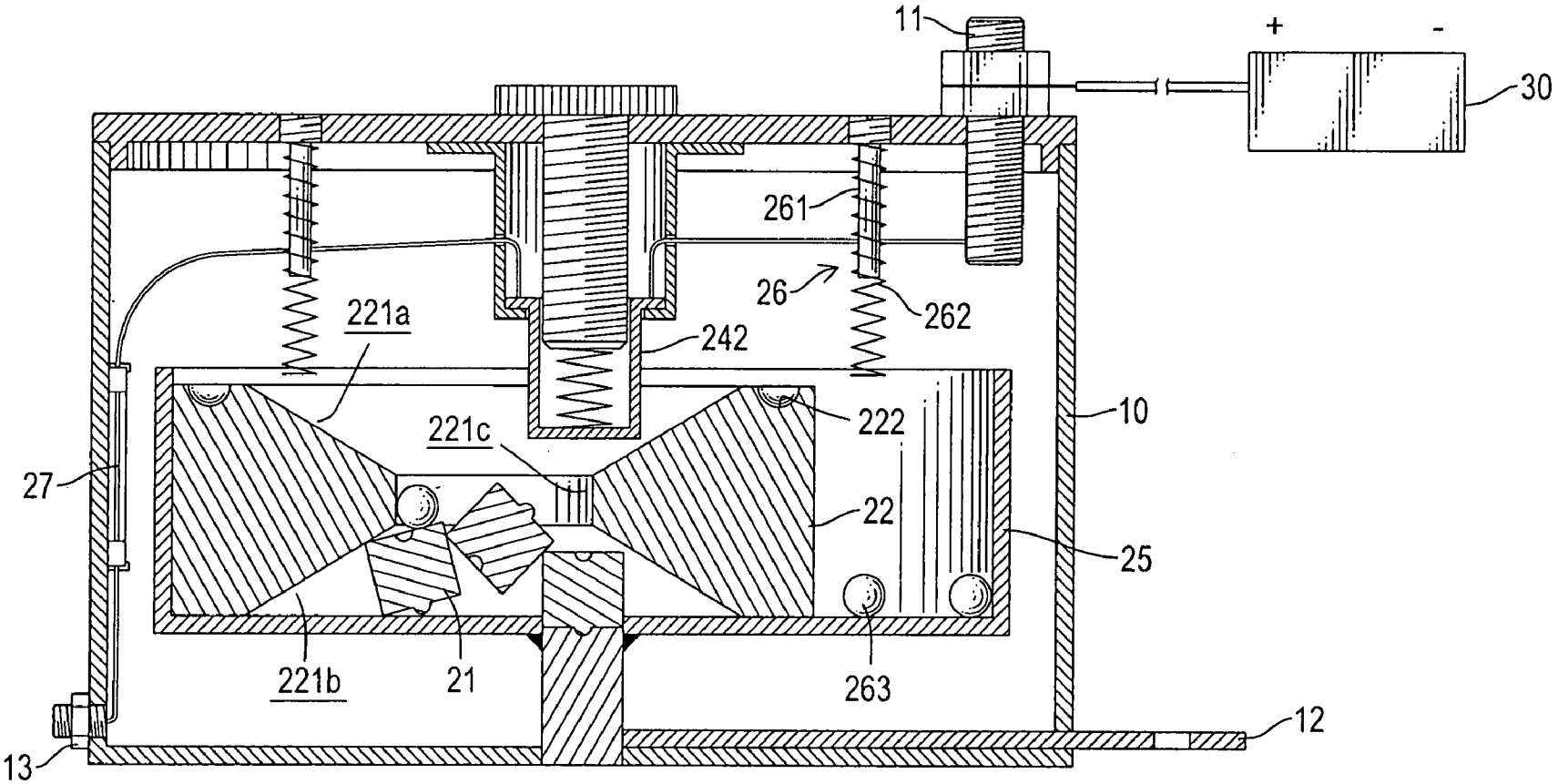
FIG. 3 is an operational view of the mechanical power breaker in accordance with the present invention.

With further reference to FIG. 3, the operational view of the power breaker shows a status after the power breaker is shaken. When the power breaker device experiences a shake resulted from, for example, a collision of vehicle, the moving element (22) is not supported by the second resilient devices (26), and then moves in the seat (25). The moving element (22) hits the conductive connector (212). The original stacked conductive blocks (21) are separated e. Therefore, the power input (11) is not electrically connected to the master power output (12) to disconnect the vehicle battery (30) and the vehicle power system. Since the power input (11) is electrically connected to the auxiliary power output (13) through the sliding conductive sleeve (242), the vehicle battery (30) still supplies power to the auxiliary power output (13). Therefore, the air bag device or anti-locking brake device can have power for operation to protect the driver and passengers.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A mechanical power breaker for a vehicle, comprising:

a casing having a top and a bottom;

a power input mounted to the casing;

a master power output mounted to the casing; and a breaker being inside of the casing and electrically connected between the power input and the master power and comprising:

a seat has an upper opening, a bottom, a through hole defined in the bottom and a pillar that is conductive, electrically connected to the master power output and has an upper and bottom sides, wherein the upper side and lower side of the pillar are respectively and securely connected between the bottom of the seat and the bottom of the casing;

a conductive connector positioned in the through hole of the seat to connect to the pillar and consisted of multiple conductive blocks stacked to form a separable long pillar;

a hollow moving element put on the bottom of the seat and surrounded the conductive connector, wherein the hollow moving element has a width smaller than that of the seat, an upper surface and a lower surface;

a first resilient support mounted on the top of the casing and extending into the casing to provide a pressing force to the top of the conductive connector; and multiple second resilient supports mounted on the top of the top of casing and extending into the casing to provide pressing forces to the top surface of the moving element in the seat; wherein in the event of vibration of the casing, the moving element is moved to hit said separable long pillar to separate said multiple conductive blocks to disconnect the electric connection between the power input and the master power output.

2. The mechanical power breaker as claimed in claim 1, wherein the first resilient support comprises:

a fixed seat securely and downwardly mounted on the top of casing and having a center opening;

a sliding conductive sleeve electrically connected to the power input, movably held in the fixed seat and passing through the center opening of the fixed seat to abut against the top of the conductive connector, the sliding conductive sleeve having a stop portion extending from an outside of the sliding conductive sleeve to abut against an inside of the fixed seat;

a screw screwed on the top of the casing and extending into the fixed seat and the sliding conductive sleeve; and a spring having two opposite ends, wherein one end connects to the sliding conductive sleeve and the other end abuts against the screw.

3. The mechanical power breaker as claimed in claim 1, wherein the upper surface of the hollow moving element is defined with multiple ball recess; and each second resilient support comprises:

a screw screwed on the top of the casing;

a spring having two opposites ends, wherein one end is connected to the screw; and one ball held in a respective ball recess on the moving element and pressed by the other end of the spring.

4. The mechanical power breaker device as claimed in claim 1, wherein each conductive block comprises a top face with a recess and a bottom face with a protruding bump held in the recess of an adjacent conductive block; and the upper side of the pillar is defined a recess to hold the bump of the bottom conductive block of the conductive connector.

5. The mechanical power breaker device as claimed in claim 2, further comprising an auxiliary power output mounted on the casing and electrically connected to the sliding conductive sleeve.

6. The mechanical power breaker device as claimed in claim 2, further comprising an auxiliary power output mounted on the casing and electrically connected to the sliding conductive sleeve through a fuse.

7. The mechanical power breaker device as claimed in claim 1, wherein the moving element further comprising:

an upper taper opening defined on the upper surface;

a lower taper openings defined on the lower surface; and a center hole communicating between the upper and lower taper openings and has a width, wherein the center hole surrounds the conductive connector and the width of the center hole is larger than that of the conductive connector.

* * * * *